US006974913B2

(12) United States Patent
Bahlmann et al.

(10) Patent No.: US 6,974,913 B2
(45) **Date of Patent: *Dec. 13, 2005**

(54) MULTIFOLDED COMPOSITE TAPE FOR USE IN CABLE MANUFACTURE AND METHODS FOR MAKING SAME

(75) Inventors: Craig Bahlmann, Hickory, NC (US); David Braun, North Attleboro, MA (US); Ethan E. Franklin, Morganton, NC (US); Tom Siekierka, Downers Grove, IL (US); Philip Shows, Hudson, NC (US); Galen Gareis, Richmond, IN (US); Gary Hemmelgarn, Richmond, IN (US); Douglas Lindstrand, Richmond, IN (US)

(73) Assignee: Neptco Incorporated, Pawtucket, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/603,567

(22) Filed: Jun. 25, 2003

(65) Prior Publication Data

US 2004/0026113 A1 Feb. 12, 2004

Related U.S. Application Data

(63) Continuation of application No. 10/020,582, filed on Dec. 14, 2001, now Pat. No. 6,624,359.

(51) Int. Cl.[7] ..... H01B 7/08
(52) U.S. Cl. ..... 174/113 C; 174/117 FF
(58) Field of Search ..... 174/36, 113 R, 174/113 C, 131 A, 117 F, 117 FF, 117 A

(56) References Cited

U.S. PATENT DOCUMENTS

| | | | | |
|---|---|---|---|---|
| 3,819,443 A | | 6/1974 | Simons et al. | 156/204 |
| 3,911,200 A | | 10/1975 | Simons et al. | 174/36 |
| 3,968,321 A | | 7/1976 | Olszewski et al. | 174/36 |
| 4,404,424 A | | 9/1983 | King et al. | 174/34 |
| 4,737,598 A | | 4/1988 | O'Connor | 174/36 |
| 4,912,283 A | | 3/1990 | O'Connor | 174/36 |
| 5,789,711 A | | 8/1998 | Gaeris et al. | 174/113 |
| 5,952,615 A | | 9/1999 | Prudhon | 174/113 |
| 5,956,445 A | * | 9/1999 | Deitz et al. | 385/100 |
| 5,969,295 A | | 10/1999 | Boucino et al. | 174/113 |
| 6,074,503 A | | 6/2000 | Clark et al. | 156/50 |

(Continued)

FOREIGN PATENT DOCUMENTS

| | | | |
|---|---|---|---|
| EP | 0 763 831 | 3/1997 | H01B 11/06 |

*Primary Examiner*—Chau N. Nguyen
(74) *Attorney, Agent, or Firm*—Mintz, Levin, Cohn, Ferris, Glovsky and Popeo, P.C.

(57) ABSTRACT

The invention provides a composite wrapping and shielding tape for use in cable manufacture. Embodiments of the composite tape comprise a single tape configuration to separate and shield individual pairs of insulated conductors housed within a cable such as a high-speed data communications cable. The single tape configurations of the invention are multifolded and assembled from foil/film laminates to form a plurality of longitudinal channels or grooves to accommodate one or more pairs of insulated conductors and a variety of cable designs. During cable manufacture, one or more pairs of insulated conductors is wrapped within a continuous shield provided by each longitudinal channel or groove, thereby separating and shielding each pair of insulated conductors and, hence, isolating or at least substantially reducing crosstalk between pairs of insulated conductors contained within the cable. The invention also provides methods for making a multifolded composite tape. The invention further provides a communications cable comprising a multifolded composite tape to separate and shield insulated conductors.

25 Claims, 10 Drawing Sheets

U.S. PATENT DOCUMENTS 6,080,935 A 6/2000 Lanoue et al. ..... 174/117
6,150,612 A 11/2000 Grandy et al. ..... 174/113
6,162,992 A 12/2000 Clark et al. ..... 174/113
6,248,954 B1 6/2001 Clark et al. ..... 174/113
6,288,340 B1 9/2001 Arnould ..... 174/113
6,624,359 B2 * 9/2003 Bahlmann et al. ..... 174/113 C

* cited by examiner

MULTIFOLDED COMPOSITE TAPE FOR USE IN CABLE MANUFACTURE AND METHODS FOR MAKING SAME

PRIOR PENDING APPLICATIONS

This application is a continuation application pursuant to 37 C.F.R. § 1.53(b) of application Ser. No. 10/020,582, filed Dec. 14, 2001, now U.S. Pat. No. 6,624,359 which is incorporated herein by reference.

FIELD OF THE INVENTION

The invention is generally directed to a composite tape for use in cable manufacture. In particular, the invention provides a multifolded composite tape constructed in a single tape configuration with a multiple of longitudinal channels or grooves for wrapping and shielding individual insulated conductors. The invention also provides methods of making a multifolded composite tape as a single tape configuration. The invention further provides a communications cable comprising a multifolded composite tape for separating and shielding one or more conductors.

BACKGROUND OF THE INVENTION

High-speed data communications cables currently in use include pairs of insulated conductors twisted together to form a two-conductor group or a transmission line. Such pairs of insulated conductors are commonly referred to in the art as "twisted pairs". Multiples of twisted pairs are typically bundled or closely spaced together within high-speed data cables. Such close proximity between twisted pairs often causes electrical energy to transfer from one twisted pair to other adjacent twisted pairs coexisting within a cable. This transfer of electrical energy between twisted pairs is a phenomenon known as crosstalk, which interferes and degrades electrical signals and data transmission. Twisted pairs must, therefore, be sufficiently separated physically and shielded electrically in order to reduce and isolate crosstalk.

Crosstalk presents a particular problem in high frequency applications wherein as the frequency of transmission increases, crosstalk increases logarithmically. Thus, the need to shield twisted pairs increases with the need for greater transmission speed. For instance, a category 7 cable used for relatively high speed data transmission is required to meet specific performance standards for crosstalk isolation established by third party testing organizations. Therefore, in order to meet such performance standards, while providing greater transmission speed and throughput, methods of shielding and isolating twisted pairs become important for maintaining the quality of data transmission.

Various prior art methods attempt to meet standards for crosstalk isolation in high-speed data communications cable and include techniques and cable designs for physically separating twisted pairs and maintaining twisted pairs in fixed positions. In addition, prior art methods include individually shielding twisted pairs to insulate twisted pairs from crosstalk. Such shielding techniques typically include various techniques and shielding tapes for tape wrapping individual twisted pairs prior to cabling. Typically, tape wrapping involves wrapping a metal or metallized tape longitudinally or helically around a twisted pair. Such tape wrapping techniques cause a portion of the metal or tape to overlap upon itself as it is wound around the twisted pair to achieve a continuous wrap. The result is that areas along the twisted cable face a metal-to-nonmetal portion of the wrapping tape at the site of a tape overlap. Typically, shielding or wrapping tape comprises a conductive, often metallic, surface and a dielectric film, often plastic, surface such that the overlap created is a metal-to-film interface. Such overlaps are susceptible to signal leakage, interference and signal degradation as well as contribute to crosstalk between adjacent twisted pairs and proximate cables. In addition, individually wrapping twisted pairs is a lengthy operation and an additional step in manufacturing twisted pairs.

Therefore, it is desirable to provide a shielding tape and techniques for individually wrapping twisted pairs prior to cabling that overcomes the problems associated with the prior art described above. Such a shielding tape and techniques would reduce or eliminate the negative effects upon electrical properties and conductor performance associated with tape overlap and more particularly would isolate crosstalk. In addition it is desirable to provide a communications cable comprising a shielding tape for physically separating and electrically isolating individual insulated conductors contained therein to substantially reduce crosstalk between adjacent conductors situated within the cable as well as between the cable and other proximately located communications cables.

SUMMARY OF THE INVENTION

According to the invention, a multifolded composite tape is provided to better facilitate isolation and electrostatic shielding of multiple pairs of insulated conductors of a high-speed data transmission cable that is required to meet the need for greater speed, throughput and quality of signal and data transmission. The multifolded composite tape of the invention is constructed as a single tape configuration having a robust shielding construction to compartmentalize and encapsulate individual pairs of insulated conductors (referred to herein as "twisted pairs") during cable manufacture. The composite tape of the invention has the benefit of using a single tape configuration that completely wraps, electrically shields, and isolates individual twisted pairs to achieve a desired crosstalk performance.

The multifolded composite tape of the invention resolves many of the problems associated with individually wrapping twisted pairs, to achieve greater consistency of electrical properties and electrical performance. In addition, the various single tape configurations of the invention increase manufacturing productivity by reducing the amount of tape required to wrap individual twisted pairs and increasing production speed. In addition, the single tape configurations provide greater strength, thereby reducing the incidence of tape break during cable manufacture. The single tape design also provides a more consistent geometry that imparts consistency and predictability with respect to electrical properties and cable performance.

The multifolded composite tape of the invention 'also' provides a number of embodiments comprising a variety of single tape configurations to simultaneously wrap and completely encapsulate a multiple of twisted pairs during cable manufacturing. The single tape configurations generally comprise one or more metallic foil/plastic film laminates that are folded and assembled to form a multiple of channels or grooves for containing twisted pairs.

Embodiments of the single tape configuration according to the invention comprise one or more laminates assembled into a single tape. Each laminate is constructed of at least one layer or sheet of a first material, such as a conductive material, bonded to at least one layer or sheet of a second material, such as an insulating dielectric material, to form a single laminate. The single laminate is a basic component of the various single tape configurations according to the invention. The construction of the laminate as described herein does not limit the invention to a single layer of conductive material, such as a metallic foil, bonded to a single layer of dielectric material, such as a plastic or polyester film, but contemplates other laminate constructions comprising more than one layer or sheet of conductive material and/or more than one layer or sheet of dielectric material. In addition, the invention is not limiting with respect to the materials of construction of the laminate layers and contemplates other materials in addition to a metallic foil and plastic or polyester film.

In a first embodiment of the invention, a single tape configuration comprises four metallic foil/film laminates folded and assembled to form a single tape configuration having an X-shaped cross-section or profile that forms or defines four channels or grooves extending longitudinally along a length of the single tape. Each laminate is constructed of at least one, layer or sheet of metallic foil bonded to at least one layer or sheet of thin plastic film to form a metallic foil/film laminate. During assembly of the single tape configuration, the foil/film laminates are folded and/or bonded such that the foil layers of the laminates are oriented to face or define the four channels or grooves. The single tape configuration which results comprises four fin-like, shield members extending radially from a center axis or vertical center line and longitudinally along the length of the tape to form or define the four channels or grooves. Each shielding member has an internal portion of dielectric material disposed between conductive material.

Each channel or groove is of sufficient size to lay at least one twisted cable therein. During cable manufacturing, four twisted pairs are laid in the X-shaped single tape configuration and therein simultaneously wrapped by utilizing one or more forming dies. The foil layer facing each channel or groove essentially provides a continuous, longitudinal foil-to-foil wrap in which a twisted pair is encapsulated. The foil-to-foil wrap physically separates and electrically shields the twisted pair by achieving a continuous and closed conductive shield. The resultant foil-to-foil contact achieved avoids the problems associated with foil-to-film overlap produced during individually wrapping twisted pairs.

In a second embodiment of the invention, a single tape configuration comprises at least one metallic foil/film laminate accordion-folded to form a single tape configuration having a cross-section or profile that forms or defines one or more channels or grooves extending longitudinally along a length of the single tape. The metallic foil/film laminate is similarly constructed as described above with respect to the foil/film laminates of the first embodiment. The metallic foil/film laminate is accordion-folded lengthwise into a multiple of pleats to achieve a single tape configuration having an accordion cross-section or profile. Each pleat can be of a substantially equal width. Each pleat includes a foil layer on a first side and a film layer on a second opposite side. During formation of the multiple of accordion pleats, each pleat having the film layer folded therein is fused or bonded to seal the pleat. The foil/film laminate is accordion-folded lengthwise until a desired number of pleats is achieved. The number of pleats created is related to the number of channels or grooves required. Thereafter, the single tape configuration is opened by unfolding the pleats having the foil layer folded therein and wrapping the single tape back upon itself such that the foil layer is oriented to face or define one or more channels or grooves. The single tape configuration which results comprises two or more fin-like shield members extending radially from a center axis or vertical center line and longitudinally along the length of the single tape to form or define the one or more channels or grooves. The single tape configuration of the second embodiment provides, the flexibility to provide as many channels and grooves as may be required to wrap any number of twisted pairs contained within a particular cable design.

In a third embodiment of the invention, a method is provided for making a composite tape for use in cable manufacture, the method comprising providing a first laminate of at least one layer of conductive material bonded to at least one layer of dielectric material; folding the first laminate conductive material-to-conductive material to form an interface of conductive material; providing; a second folded laminate constructed and folded similar to the first folded laminate; butting the first and second folded laminates fold-to-fold; providing a third laminate and a fourth laminate, the third laminate and the fourth laminate each having at least one layer of conductive material bonded to at least one layer of dielectric material; bonding the layer of dielectric material of the third laminate to a first plane of dielectric material formed by the dielectric material of the butted first and second folded laminates; bonding the layer of dielectric material of the fourth laminate to a second opposing plane of dielectric material formed by the dielectric material of the butted first and second folded laminates; and opening the conductive material interfaces to form a plurality of fin-like shielding members that extend radially from a center axis and longitudinally along a length of the laminates to define a plurality of channels.

In a fourth embodiment of the invention, a method is provided for making a composite tape for use in cable manufacture, the method comprising providing a laminate of at least one layer of conductive material bonded to at least one layer of dielectric material, the laminate having a length and a width; folding the laminate along its length repeatedly to form a multiple of longitudinal accordion pleats, each pleat having either a dielectric material interface or a conductive material interface disposed therein; bonding the dielectric material interfaces, and opening the conductive material interfaces to form a plurality of fin-like shielding members extending radially from a center axis and longitudinally along the length of the laminate to define a plurality of channels.

In a fifth embodiment of the invention, a communications cable is provided comprising a tubular jacket; a composite tape contained within the jacket including two or more fin like shielding members joined at a center axis, each shielding member extending radially from the center axis and longitudinally along a length to define two or more channels, each shielding member having an internal portion of a first material disposed between portions of a second material; and at least one twisted pair of insulated conductors disposed in each of the channels.

In a sixth embodiment of the invention, a communications cable is provided comprising a tubular jacket and a composite tape constructed according to the method of the invention as described with respect to the fourth embodiment. The composite tape is contained within the jacket and includes two or more fin-like shielding members joined at a center axis, each shielding member extending radially from the center axis and longitudinally along a length to define two or more channels, each shielding member having an internal portion of a first material disposed between portions of a second material; and at least one twisted pair of insulated conductors disposed in each of the channels.

BRIEF DESCRIPTION OF THE DRAWINGS

For a better understanding of the present invention, reference is made to the drawings, which are incorporated herein by reference and in which.

DETAILED DESCRIPTION OF THE INVENTION

Illustrative embodiments of the present invention described below are directed to a composite tape for use in manufacture of communications cable. In particular, the present invention provides a multifolded composite tape for shielding pairs of insulated conductors or twisted pairs of a high-speed data transmission cable. The multifolded composite tape of the invention is constructed of one or more laminates. Each laminate is formed by at least one layer of conductive material, such as a metallic foil, bonded or laminated to at least one layer of dielectric material, such as a polyester or plastic film. The one or more laminates are folded and assembled into a single tape configuration. The single tape configuration includes a number of laminate portions or fin-like shielding members that extend radially from a center axis or a vertical center line to define a multiple of channels or grooves extending longitudinally along a length of the single tape. The single tape configuration can comprise any number of channels or grooves to accommodate the number of twisted pairs contained within a particular cable design. Each channel or groove is of sufficient size to hold at least one twisted pair. The multifolded composite tape is assembled into the single tape configuration in such a manner that the conductive material, such as a metallic foil, of the shielding members is oriented to face or define the multiple of longitudinal channels or grooves and the twisted pairs contained therein. During cable manufacturing, at least one twisted pair is laid in each channel and thereafter the composite tape is simultaneously wrapped around the twisted pairs of the cable by utilizing one or more forming dies. Each twisted pair contained within a channel or groove is individually wrapped and completely, encapsulated by the conductive material or metallic foil. In effect, each twisted pair is physically separated and electrically shielded from other twisted pairs within the cable by a continuous longitudinal shield of conductive material or metallic foil provided by the single tape configuration.

The multifolded composite tape of the invention provides a number of embodiments comprising a variety of single tape configurations to form any number of longitudinal channels or grooves corresponding to the twisted pairs that coexist within a single cable. Embodiments of the invention will be described below in further detail with reference to FIGS. 1–16, which are presented for illustrating embodiments and are not intended to limit the scope of the claims.

Figure 1:
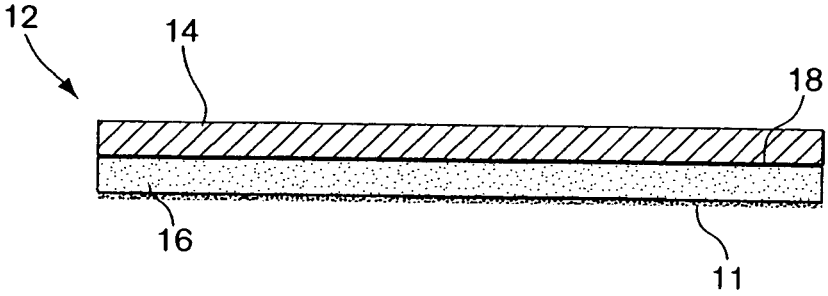
FIG. 1 is a cross-sectional view of a foil/film laminate.

Referring to FIGS. 1–5, a first embodiment of a multifolded composite tape according to the invention is depicted. FIG. 1 provides a cross-sectional view of a laminate 12 that is a basic component of a variety of single tape configurations of the invention. The laminate 12 comprises at least one layer of a first material, such as a conductive material 14, having a length substantially longer than a width to form a strip of suitable, dimensions to construct a single continuous tape. In one embodiment, the conductive material includes, although is not limited to, a metallic foil comprised of a conductive metal suitable for use in data transmission cables such as, for example, aluminum, copper, tinned copper, silver steel or the like. In the first embodiment, the conductive material includes an aluminum or copper metallic foil having a thickness in a range of from about 0.00015 inch to about 0.006 inch, and preferably in a range of from about 0.00035 inch to about 0.003 inch. The aluminum or copper metallic foil is disposed on at least one layer of a second material, such as a dielectric material 16, having a length and a width substantially similar to the length and width of the metallic foil. In one embodiment, the dielectric material includes, although is not limited to, an insulating material suitable for use in data transmission cables such as, for example, polyester film, polypropylene, polyethylene, polyvinyl chloride, polyvinylidene fluoride, a polyamide, a polyimide or the like. In the first embodiment, the dielectric layer includes a thin film of polypropylene or polyester film having a thickness in a range of from about 0.0001 inch to about 0.006 inch, and preferably in a range of from about 0.00028 inch to 0.003 inch.

As shown in FIG. 1, a layer or film of bondable or fusible material 11 is disposed on at least one surface of the dielectric layer 16. As described herein in further detail with reference to FIGS. 2–3, the bondable layer or fusible film 11 serves to bond or fuse the dielectric layers of one or more laminates when the dielectric layers are disposed together or positioned face-to-face during the assembly of one or more laminates into a single tape configuration according to the invention. The bondable layer or fusible film 11 includes a layer or a film of a suitable material including, although not limited to, ethyl acrylic acid (EAA), ethyl vinyl acetate (EVA) or other thermoplastic polymers, which may be applied to the dielectric layer as a coating or co-extruded as a component of the dielectric material during its formation. The dielectric layers 16 disposed face-to-face during assembly of the single tape configuration are bonded or fused by an application of heat and/or pressure, or by any other method or means, well known in the art.

As shown in FIG. 1, the aluminum or copper metallic foil layer 16 and the polypropylene or polyester film layer 14 are laminated together by any method or means well known in the art such as, for example, by a suitable adhesive 18, including, although not limited to, a heat-fusible adhesive resin, a solvent-based adhesive or a water-based adhesive. The adhesive 18 is disposed between the aluminum or copper metallic foil layer and the polypropylene or polyester film layer to bond the conductive and dielectric layers together to form a metallic foil/plastic film laminate 12.

The metallic foil/plastic film laminate 12 acts as a basic component or a building block of the various embodiments of the multifolded composite tape according to the invention. Although the foil/film laminate shown in FIG. 1 includes at least one layer of conductive material bonded to at least one layer of dielectric material, it is understood that the foil/film laminate according to the invention can include more than one layer of conductive material and more than one layer of dielectric material. The foil/film laminate may comprise, for instance, two or more layers of conductive material and two or more layers of dielectric material to form a laminate assembled to comprise a foil/film/foil/film layer configuration. Thus, the invention is not limiting with respect to the composition of the laminate and the number of layers of the laminate from which the various embodiments of the composite tape are formed according to the invention.

Figure 2:
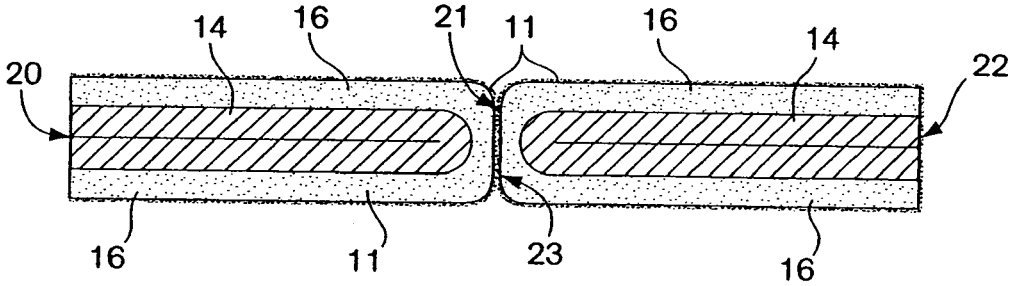
FIG. 2 is a cross-sectional view of two folded foil/film laminates butted fold-to-fold.
Figure 3:
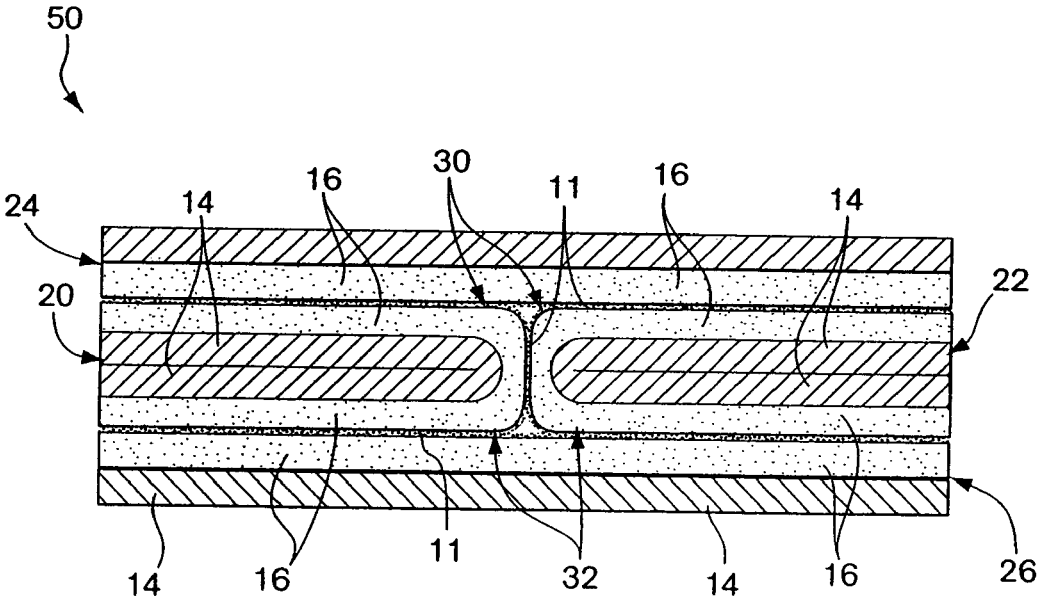
FIG. 3 is a cross-sectional view of four foil/film laminates assembled to form a single tape configuration according to a first embodiment of the invention.
Figure 4:
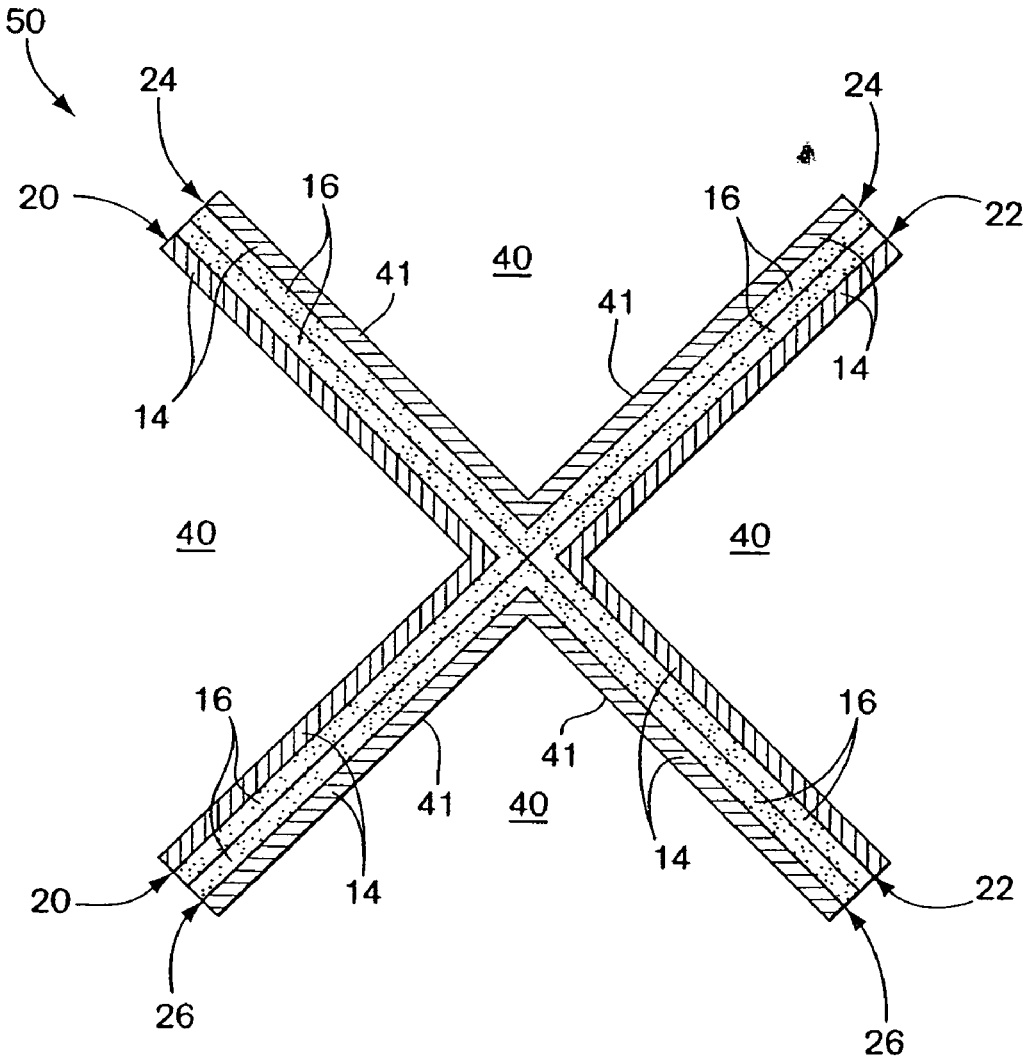
FIG. 4 is a cross-sectional view of the single tape configuration according to the first embodiment having an X-shaped cross-section or profile.
Figure 5:
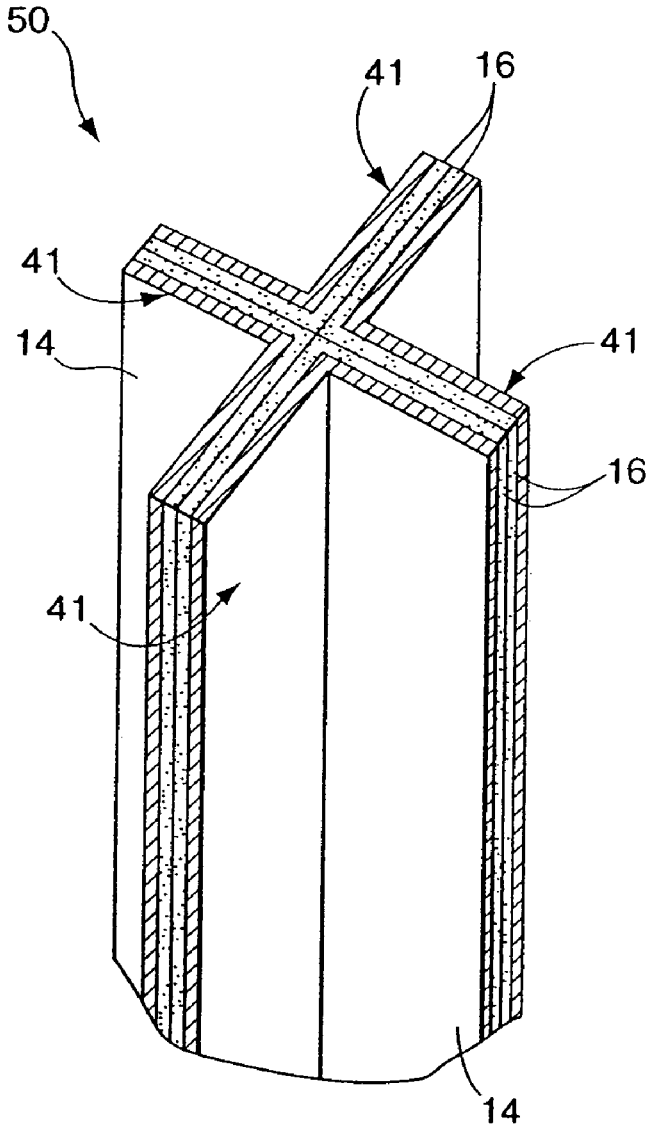
FIG. 5 is a perspective view of the single tape configuration according to the first embodiment illustrating longitudinal channels or grooves formed by the X-shaped profile.

FIGS. 2–5 illustrate cross sectional views of the first embodiment of the multifolded composite tape according to the invention. As shown in FIGS. 4–5, the multifolded composite tape comprises a single tape configuration 50 having an X-shaped cross-section or profile. The single tape configuration 50 comprises four foil/film laminates 12, wherein each foil/film laminate is constructed as described above. The four foil/film laminates are assembled to form fin-like shielding members 41 that extend radially from a center axis or a vertical center line to define four channels or grooves 40 and the X-shaped cross section. The channels or grooves 40 extend longitudinally along a length of the single tape. The foil/film laminates are assembled into the single tape configuration 50 in such a manner that the foil layers 14 are oriented on the exterior surfaces of the single tape configuration to face or define each channel or groove 40.

As shown in FIG. 2, the single X tape configuration 50 is achieved by folding each of a first foil/film laminate 20 and a second foil/film laminate 22 upon itself lengthwise. Preferably, each foil/film laminate is folded in half lengthwise foil-to-foil such that the film layer 16 is disposed outside and the foil layer 14 is disposed inside the folded laminate 20 and 22. The foil layer 14 forms an interface sandwiched between portions of the film layer 16. A fold edge 21 of the first laminate 20 and a fold edge 23 of the second laminate 22 are disposed adjacent to each other fold-to-fold and butted together.

As shown in FIG. 3, a third foil/film laminate 24, similarly constructed as the first and second laminates, is disposed on a first plane 30 formed by the butted first and second folded laminates such that the bondable layers or fusible films 11 of the dielectric film layers 16 are face-to-face. Similarly, a fourth foil/film laminate 26 is placed on a second opposing plane 32 formed by the butted first and second folded laminates such that the bondable layers or fusible films 11 of the dielectric layers 16 are face-to-face. The first and second folded laminates 20 and 22 are essentially sandwiched between the third and fourth unfolded laminates 24 and 26. The bondable layers or fusible films 11 of the dielectric film layers 16 and the butted fold edges 21 and 23 are then bonded or fused by an application of sufficient heat to the sandwiched laminates, or by some other suitable method or means well known in the art. In one embodiment, the laminates are preferably subjected to a bonding temperature generally in a range of from about 70° C. to about 150° C. for a bonding time of from about 0.1 to about 2.0 seconds. One skilled in the art can adjust a bonding temperature, a bonding time and/or a bonding pressure to obtain ideal results with respect to bonding or fusing the dielectric layers of the laminates.

As shown in FIG. 4, the single tape configuration unfolds into an X-shaped cross section by opening and separating the interfaces of the foil 14 of the first and second folded laminates 20 and 22, and folding back the foil layers 14 of the third and fourth laminates 24 and 26 to form four longitudinal channels or grooves 40. As shown in the perspective view of the single X tape configuration of FIG. 5, the four channels or grooves longitudinally extend the length of the tape. The foil layers 14 face outward to define each of the channels or grooves which essentially provide foil-lined channels or grooves in which the twisted pairs are laid.

Figure 16:
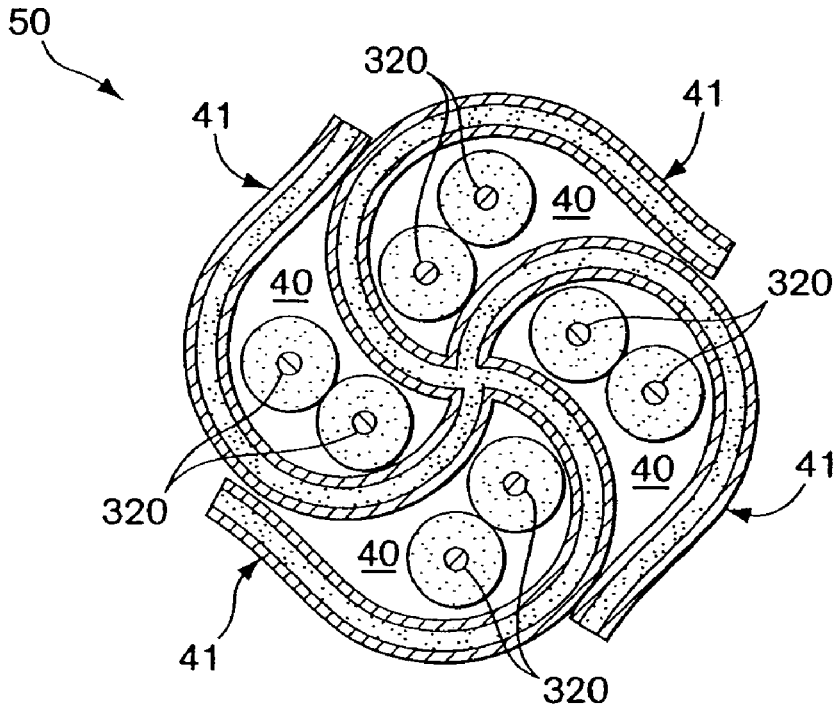
FIG. 16 is a cross-sectional view, of a single tape configuration according to the first embodiment or the second embodiment of the invention wrapped around four twisted pairs.

Referring to FIG. 16, a feature and advantage of the composite tape according to the invention is that the single X tape configuration resolves many of the problems associated with individually wrapping twisted pairs with a metal or metallized tape prior to cable manufacture. During cable manufacturing, at least one twisted pair is laid in each of the channels or grooves formed by the single X tape configuration. The twisted pairs are then simultaneously wrapped by utilizing one or more forming dies. As shown in FIG. 16, each twisted pair is thereby individually wrapped and completely encapsulated within the foil layer of each channel or groove. The channels or grooves of the single X tape configuration provide a continuous foil-to-foil wrap that surrounds and encases each twisted pair and results in a shield of foil-to-foil contact. Unlike prior art methods that either longitudinally cigarette-wrap or helically wrap a metallized tape around each twisted pair, which results in foil-to-film overlaps that cause inconsistent shielding, signal leakage or interference, the continuous foil-to-foil wrap provided by the single tape configuration results in a consistent, closed conductive shield around each twisted pair. The continuous conductive shield achieved by the single X tape configuration helps to reduce crosstalk between twisted pairs, to reduce alien crosstalk between cables, and to prevent the cable from causing or receiving electromagnetic interference that can interfere with or degrade signals and data transmission. The level of shielding and isolation of twisted pairs achieved by the single X tape configuration also provides more consistent and predictable electrical properties and improved electrical qualities that, consequently, result in finished cables of higher performance required for high speed data transmission.

The single X tape configuration also provides the additional benefit of providing a more consistent geometry of finished cables than cables produced by individually wrapping each twisted pair, which further enhances electrical qualities. In addition, as the width and thickness of the single X tape configuration can be readily varied for different cable sizes, the single X tape configuration allows flexibility with respect finished cable design.

In one aspect of the first embodiment of a single tape configuration according to the invention, two or more foil/fusible film laminates are utilized to form a single tape. Each foil/fusible film laminate comprises at least one layer of a conductive material, such as a metallic foil, on which at least one layer or one coat of a bondable material or fusible film is disposed. The foil/fusible film laminate serves as a basic component of the single tape configuration and may be folded and assembled together as described with respect to FIGS. 2–5 with three other similarly constructed foil/fusible film laminates to form a single tape configuration having an X-shaped cross-section or profile, which forms or defines four channels or grooves.

Figure 6:
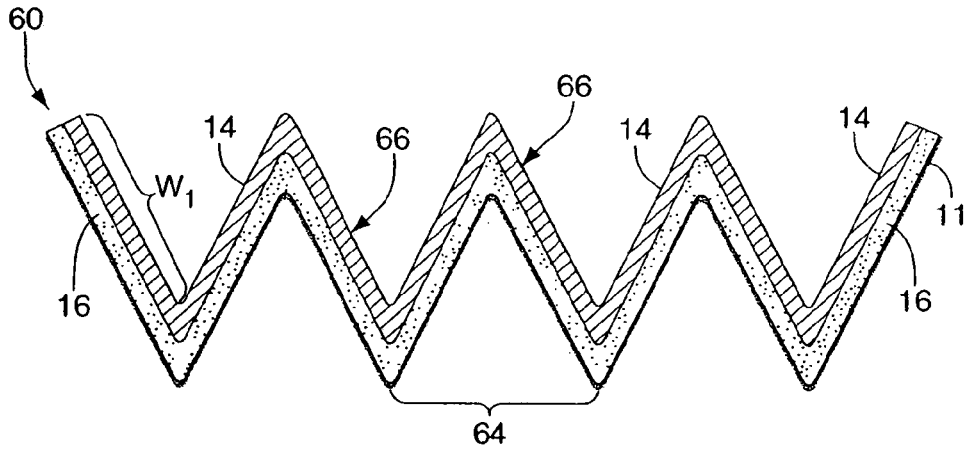
FIG. 6 is cross-sectional view of a single foil/film laminate accordion-folded according to a second embodiment of the invention to form a single tape configuration.
Figure 7:
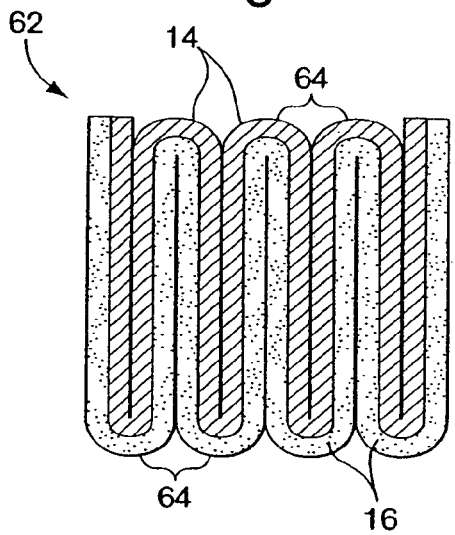
FIG. 7 is a cross-sectional view of the accordion folded laminate of FIG. 6 with the film layers bonded or fused together.
Figure 8:
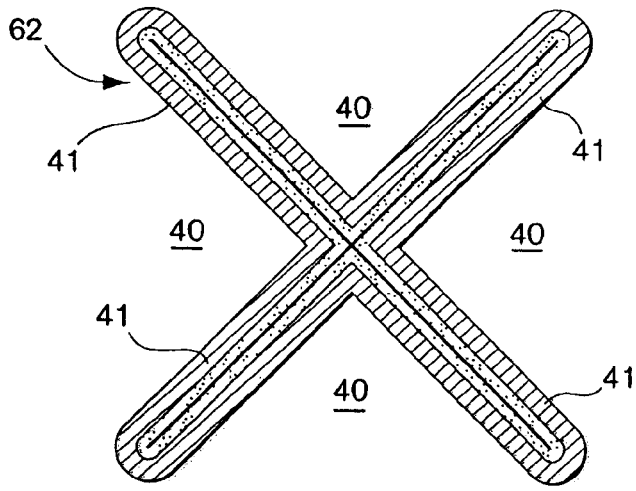
FIG. 8 is a cross-sectional view of the single tape configuration of the second embodiment illustrating an X-shaped cross-section or profile.

Referring to FIGS. 6–8, cross-sectional views of a second embodiment of the multifolded composite tape according to the invention are depicted. In this embodiment, the composite tape 60 comprises a single laminate 60 having a width sufficient to fold lengthwise into a multiple of pleats and a length substantially greater than the width to form a strip of continuous material to assemble a single tape configuration.

The single laminate 60 is similarly constructed as the laminate described with reference to FIG. 1. As shown, in FIG. 6, the single laminate 60 comprises at least one layer of a first material, such as a conductive material 14, having a length substantially longer than a width to form a strip of suitable dimensions to construct a single continuous tape. In one embodiment, the conductive material includes, although is not limited to, a metallic foil comprised of a conductive metal suitable for use in data transmission cables such as, for example, aluminum, copper, tinned copper, silver, steel or the like. In the second embodiment, the conductive material includes an aluminum or copper metallic foil having a thickness in a range of from about 0.00015 inch to about 0.006 inch, and preferably in a range of from about 0.00035 inch to about 0.003 inch. The aluminum or copper metallic foil is disposed on at least one layer of a second material, such as a dielectric material 16, having a length and a width substantially similar to the length and width of the metallic foil. In one embodiment, the dielectric material includes, although is not limited to, an insulating material suitable for use in data transmission cables such as, for example, polyester film, polypropylene, polyethylene, polyvinyl chloride, polyvinylidene fluoride, a polyamide, a polyimide or the like. In the second embodiment, the dielectrics layer includes a thin film of polypropylene or polyester film having a thickness in a range of from about 0.0001 inch to about 0.006 inch, and preferably in a range of from about 0.00028 inch to 0.003 inch.

As shown in FIG. 6, a layer or film of bondable or fusible material 11 is disposed on at least one surface of the dielectric layer 16. As described herein in further detail with reference to FIGS. 7–8, the bondable layer or fusible film 11 serves to bond or fuse the dielectric layer interfaces defined by the multiple of pleats as a result of multi-folding the single laminate lengthwise during the assembly of a single tape configuration according to the invention. The bondable layer or fusible film 11 includes a layer or a film of a suitable material including, although not limited to, ethyl acrylic acid (EAA), ethyl vinyl acetate (EVA), or other thermoplastic polymers, which may be applied to the dielectric layer as a coating or co-extruded as a component of the dielectric material during its formation. The dielectric layer interfaces formed during the assembly of the single tape configuration are bonded or fused by an application of heat and/or pressure, or by any other method or means well known in the art.

The aluminum or copper metallic foil layer 16 and the polypropylene or polyester film layer 14 are laminated together by any method or means well known in the art such as, for example, by a suitable adhesive 18, including, although not limited to, a heat-fusible adhesive resin, a solvent-based adhesive or a water-based adhesive. The adhesive 18 is disposed between the aluminum or copper metallic foil layer and the polypropylene or polyester film layer to bond the conductive and dielectric layers together to form a metallic foil/plastic film laminate 12.

As shown in FIG. 6, the foil/film laminate 12 is folded to'form a multiple of accordion pleats 66, wherein each pleat 64 has a substantially equal Width $W_1$ and the foil/film laminate 60 includes an accordion-like cross-section. The foil/film laminate 60 is folded into a desired multiple of accordion pleats 66 with the foil layer 14 of the laminate on a first side of each pleat 64 and the film layer 16 on a second opposite side of each pleat. Each pleat 64 includes an interface of either the foil layer 14 or the film layer. 14. As the foil/film laminate 60 is folded to form a pleat, the bondable layer or fusible film 11 of the dielectric film layer 16 interface is bonded or fused. In one embodiment, a sufficient heat is applied to the pleat 64 upon the formation of the dielectric film layer 16 interface to bond or fuse the bondable layer or fusible film 11, thereby sealing the pleat 64. In one embodiment, the pleat is subjected to a bonding temperature generally in a range of from about 70° C. to about 150° C. for a bonding time of from about 0.1 to about 2.0 seconds. One skilled in the art can adjust a bonding temperature, a bonding time and/or a bonding pressure to obtain ideal results with respect to bonding or fusing the dielectric film layer interfaces.

Upon completion of the accordion folding of the foil/film laminate and fusing of the film layer interfaces, the single tape configuration 62 is unfolded by opening the pleats comprising the foil layer interfaces. The single tape configuration is then folded back upon itself and bonded to form an X-shaped cross-section, as shown in FIG. 8. The multiple of pleats 66 essentially forms fin-like shielding members 41 that extend radially from a center axis or a vertical center line to define a multiple of channels or grooves 40. As described above with respect to the first embodiment, the multiple of channels or grooves 40 extends longitudinally along the length of the single X tape configuration 62, and the foil layer faces or defines the multiple of channels or grooves 40. Although the single X tape configuration is formed from a single foil/film laminate rather than assembled from a number of separate foil/film laminates, the resultant X-shaped cross-section is able to contain at least four twisted pairs.

Figure 9:
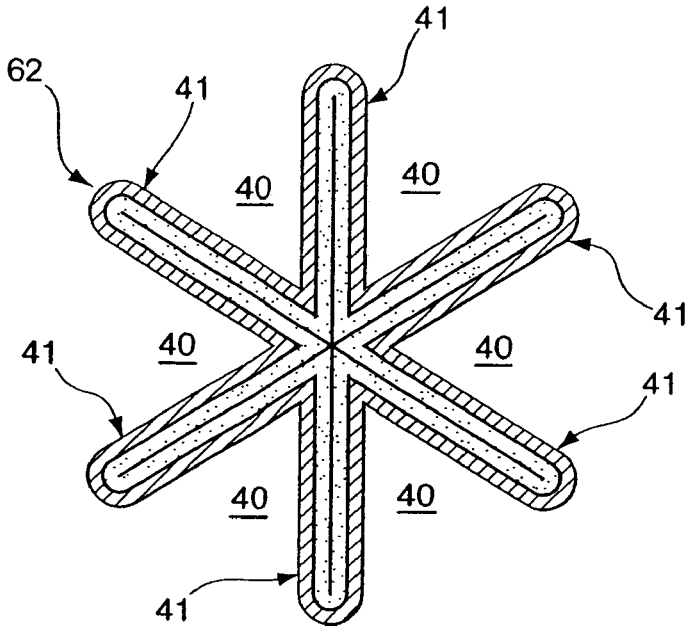
FIG. 9 is a cross-sectional view of the single tape configuration of the second embodiment illustrating six longitudinal channels or grooves formed by the accordion-folded single laminate.

Although the single X tape configuration 62 of the second embodiment illustrated in FIG. 8 includes, four longitudinal channels or grooves 40, it is understood that the second embodiment is not limited to the single X tape configuration comprising four channels or grooves. Rather, the second embodiment contemplates other single tape configurations of the film/foil laminate 60 including, although not limited to, accordion folding the single laminate to define as few as two and three channels or grooves or as many as six or more channels or grooves, depending upon the number of twisted pairs required by a cable design. Referring to FIG. 9, in one embodiment, a single tape configuration 62 defines six longitudinal channels or grooves 40 formed by accordion folding a single foil/film laminate 60. The single tape configuration of the second embodiment, therefore, provides flexibility with respect to the width and thickness of the single film/foil laminate used to form a composite tape to accommodate different numbers of twisted pairs and a wide variety of data transmission cable designs.

Figure 10:
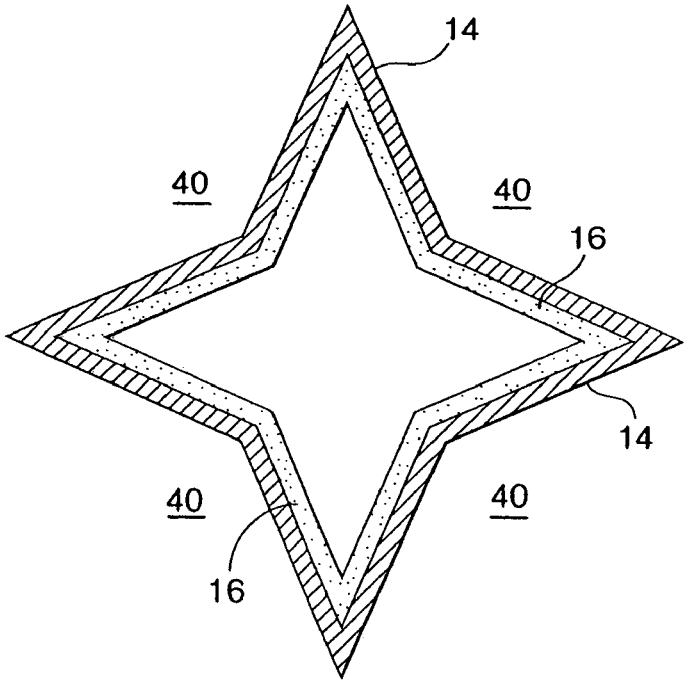
FIG. 10 is a cross-sectional view of one aspect of the single tape configuration of the second embodiment.

In addition, the second embodiment of the multifolded composite tape 62 according to the invention is not limited to the single X tape configuration shown in FIGS. 6–9. Referring to FIG. 10, one aspect of the second embodiment includes an alternative configuration of a single tape that is formed by accordion folding a foil/film laminate 60 into a multiple of pleats 66, without bonding or fusing the interface of the film layer 16 of each pleat 64. The resulting single, tape configuration 64 includes a single tape configuration having a flexible and configurable profile and an accordion cross-section. As described above with respect to the first and second embodiments, the multiple of pleats 66 ultimately forms a multiple of longitudinal channels or grooves 40 when the accordion-folded foil/film laminate 60 is unfolded. Similarly, each of the four channels or grooves 40 shown in FIG. 10 is sized to lay at least one twisted pair therein. Although the multifolded composite tape illustrated in FIG. 10 includes four parallel longitudinal channels or grooves 40, it is understood that the single tape configuration 64 is not limited to four channels or grooves as shown, but can also comprise any number of channels or grooves to accommodate a wide variety of cable designs.

In addition to the consistency of electrical properties and the enhanced performance imparted by the embodiments of the single tape configuration according to the invention, the single tape configuration has the additional benefit of improving manufacturing productivity. In particular, the single tape configuration provides greater and more consistent strength than shielding tape helically or cigarette-wrapped longitudinally around individual twisted pairs, which results in a reduction of tape break that occurs during cable manufacture. Greater tape strength also reduces the risk of reduced or failed electrical performance of installed cables. The single tape configuration also increases manufacturing speed by eliminating the lengthy operation and additional step of tape, wrapping individual twisted pairs prior to cabling and by reducing the extent of tape break that would interrupt the cabling process. The single tape configurations described herein also require less tape than is needed to individually wrap twisted pairs and, thus, are more economical to use. In addition, to achieve similar electrical properties and performance as is attained by the overall and continuous wrap provided by the single tape configuration according to the invention, a greater width of conventional shielding tape would be required to individually wrap twisted pairs. Therefore, the single tape configuration increases the efficiency of wrapping twisted pairs. In addition, the single tape configuration can be readily supplied to cable manufacturers, and makes ordering and inventorying easier for cable manufacturers.

In one, aspect of the second embodiment of a single tape configuration according to the invention, at least a first foil/fusible film laminate is used to form a single tape. The foil/fusible film laminate comprises at least one layer of a conductive material, such as a metallic foil, on which at least one layer or one coat of a bondable material or fusible film is disposed. The foil/fusible film laminate serves as a basic component of the single tape configuration and may be accordion-folded and assembled as described with respect to FIGS. 6–7 to form a single tape configuration having an accordion cross-section or profile which forms or defines one or more channels or grooves.

Figure 11:
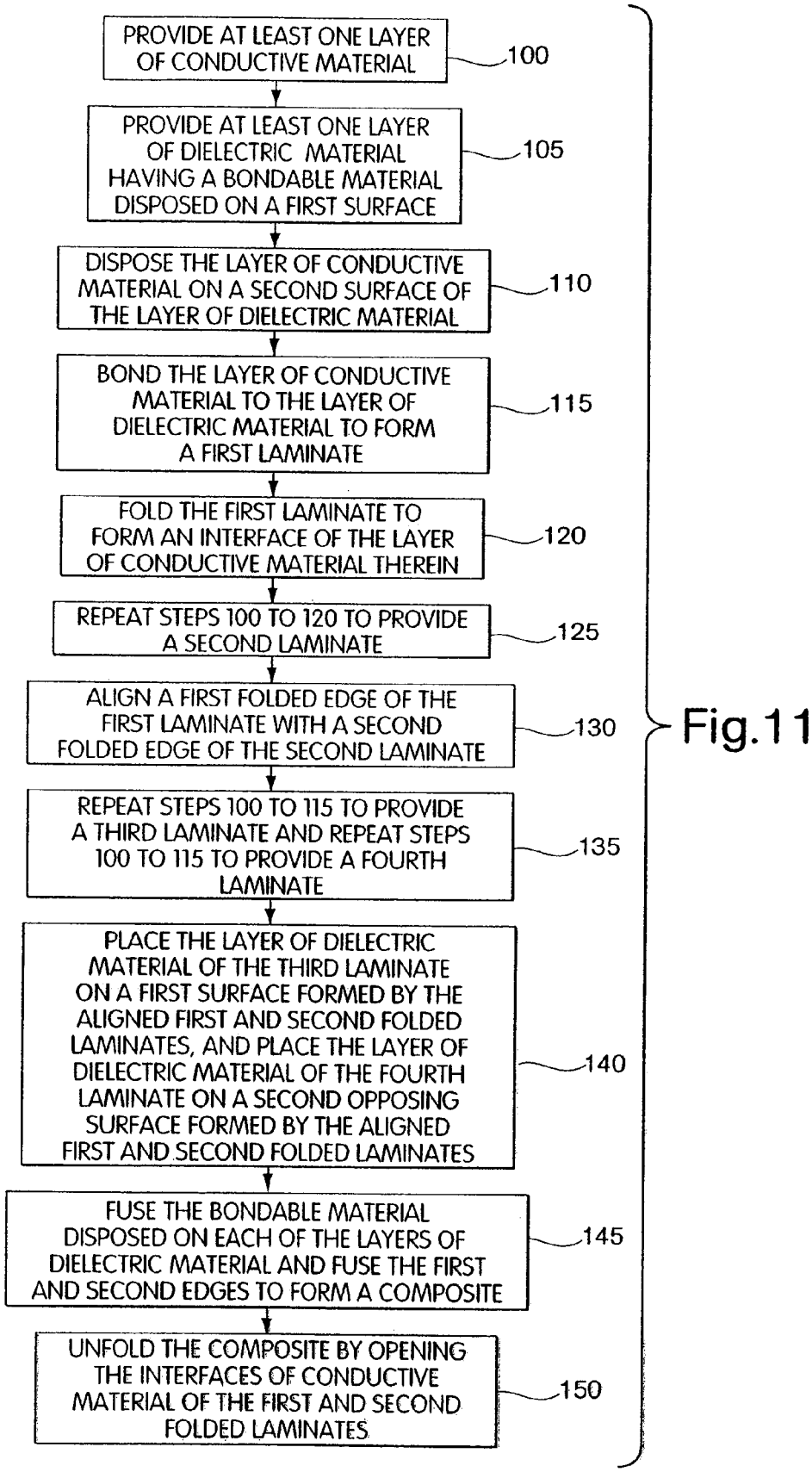
FIG. 11 is a flow diagram illustrating a third embodiment of the invention providing a method for making a single tape configuration having an X-shaped cross-section or profile.

Referring to FIG. 11, a third embodiment of the invention provides a method for making a multifolded composite tape for use in manufacturing data transmission cable having an X-shaped or +-shaped cross-section or profile. The method of the third embodiment comprises steps of providing at least one layer of a first material, such as a conductive material suitable for use in cable manufacturing, having a length and a width with the length being substantially greater than the width to form a strip of the conductive material with desired dimensions (Step 100). In one embodiment of the method according to the invention, the conductive material comprises a metallic foil including a conductive metal such as, although not limited to, aluminum, copper, tinned copper, silver, steel or the like having a thickness in a range of from about 0.00015 inch to about 0.006 inch, and preferably in a range of from about 0.00035 inch to about 0.003 inch. The method further comprises providing at least one layer of a second material, such as a dielectric material suitable for use in cable manufacturing having a length and a width substantially similar to the length and, width of the conductive material to form a strip of dielectric material with desired dimensions (Step 105).

In one embodiment of the method according to the invention, the dielectric material comprises an insulating material such as, although not limited to, polyester film, polypropylene, polyethylene, polyvinyl chloride, polyvinylidene fluoride, a polyamide, a polyimide or the like a thickness in a range of from about 0.0001 inch to about 0.006 inch, and preferably in a range of from about 0.00028 inch to 0.003 inch.

In one embodiment of the method according to the invention, a layer or film of bondable or fusible material is disposed on at least one surface of the dielectric material. The bondable layer or fusible film serves to bond or fuse the dielectric material comprising one or more laminates when the dielectric materials are disposed together or positioned face-to-face during the assembly of a single tape configuration. The bondable layer or fusible film includes a layer or a film of a suitable material including, although not limited to, ethyl acrylic acid (EAA), ethyl vinyl acetate (EVA) or other thermoplastic polymers, which may be applied to the dielectric layer as a coating or co-extruded as a component of the dielectric material during its formation.

The method comprises disposing the layer of conductive material on the layer of dielectric material, preferably such that the length and width of the conductive and dielectric layers are aligned with one another (Step 110), and then bonding or laminating the conductive and dielectric layers to form a first laminate (Step 115). In one embodiment of the method according to the invention, the conductive and dielectric layers are bonded to form the first laminate by disposing a suitable adhesive between the conductive and dielectric layers such as, although not limited to, a heat-fusible adhesive resin, a solvent-based adhesive or a water-based adhesive. The first laminate comprised of at least one conductive layer and at least one dielectric layer acts as a basic component or a building block for use in the method according to the invention for making a multifolded composite tape in a single tape configuration. However, the method of the invention as described herein utilizing the first laminate should not be considered a limiting. The method may utilize the first laminate comprised of two or more layers of conductive, material and two or more layers of dielectric material to form a multi-layer first laminate of, for instance, film/foil/film/foil layers.

The method further comprises folding the first laminate lengthwise; and preferably in half lengthwise wherein the conductive layer forms an interface inside the first folded laminate sandwiched between portions of the dielectric layer forming a surface of the laminate (Step 120). The method comprises providing a second folded laminate (Step 125) similarly constructed and folded according to the method as described above in Steps 100–120, and laying the first and second folded laminates adjacent to each other fold-to-fold to align and butt the folds together (Step 130).

The method further comprises providing a third unfolded laminate and a fourth unfolded laminate (Step 135) similarly constructed according to the method of the invention as described above in Steps 100–115. The method comprises placing the dielectric layer of each of the third and fourth unfolded laminates on one of two opposing planes of dielectric material formed by butting the first and second folded laminates (Step 140), such that the bondable layer or fusible film of the dielectric layers are face-to-face and the first and second folded laminates are sandwiched between the third and fourth unfolded laminates. The method comprises bonding or fusing the bondable layers or the fusible films of the dielectric layers and the, butted folds to form a single composite (Step 145). In one embodiment of the method according to the invention, bonding or fusing the bondable layers or the fusible films of the dielectric layers includes applying a sufficient heat, and/or a sufficient pressure, to the sandwiched laminates to bond or fuse the dielectric layers. In one embodiment of the method according to the invention, the sandwiched laminates are subjected to a bonding temperature generally in a range of from about 70° C. to about 150° C. for a bonding time of from about 0.1 to about 2.0 seconds. One skilled in the art can adjust a bonding temperature, a bonding time and/or a bonding pressure to obtain ideal results with respect to bonding or fusing the dielectric layers of the sandwiched laminates.

The method finally comprises opening the interfaces of the conductive layers of the first and second folded laminates to unfold the single composite, thereby forming a single tape configuration of four longitudinal channels or grooves having an X-shaped cross-section or profile (Step 150).

Figure 12:
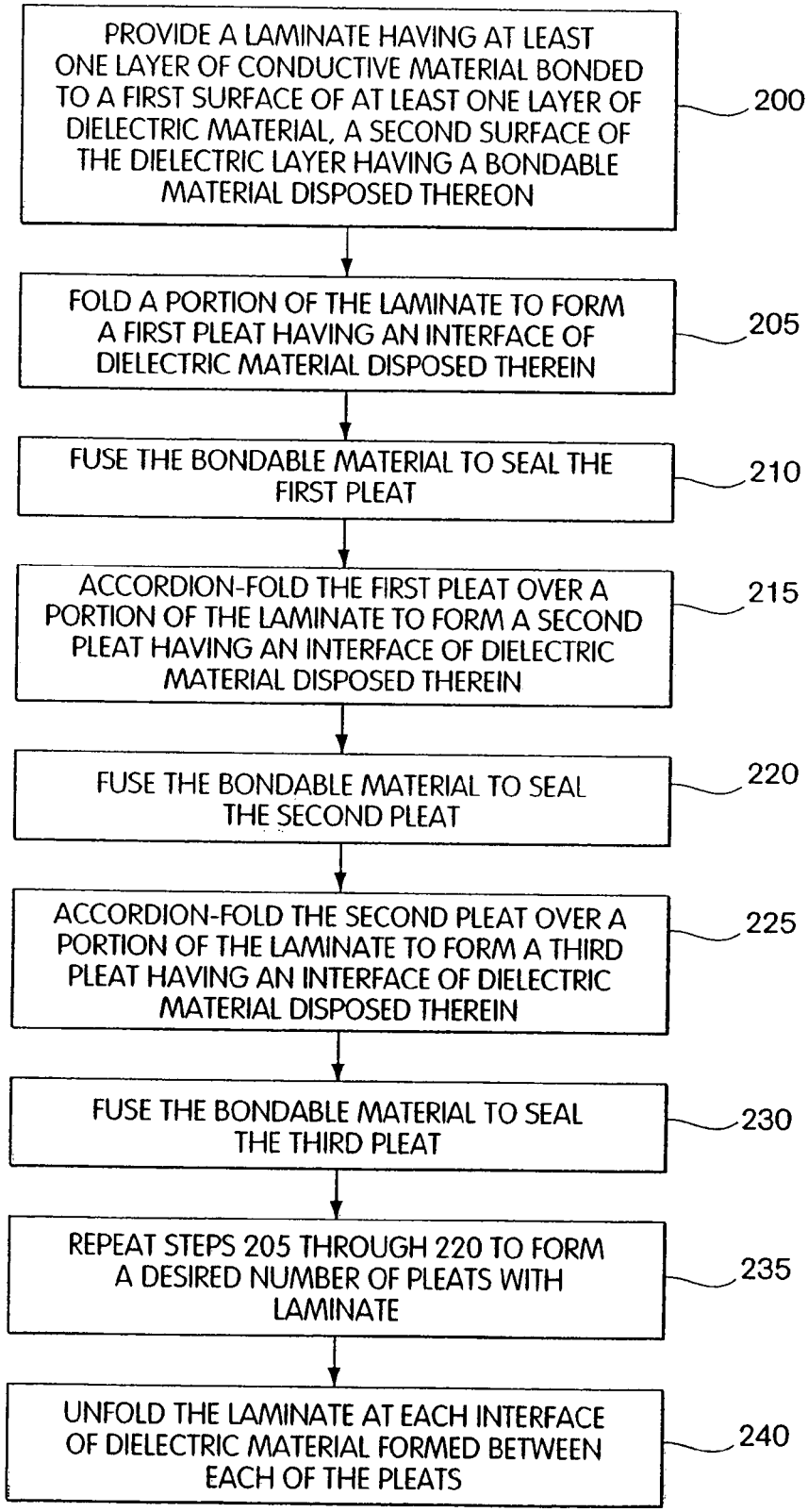
FIG. 12 is a flow diagram illustrating a fourth embodiment of the invention providing a method for making a single tape configuration having an accordion-folded cross-section or profile.

Referring to FIG. 12, a fourth embodiment of the invention provides a method for making a multifolded composite tape for use in manufacturing data transmission cable from at least a first laminate similarly constructed as the foil/film laminates described with respect to the method of the third embodiment of the invention. The method comprises steps of providing the first laminate constructed of at least one layer of conductive material, such as a metallic foil, bonded to at least one layer of dielectric material, such as an insulating plastic film. The dielectric layer includes a layer or a coat of bondable material or fusible film disposed thereon. The first laminate has a width and a length with the length being substantially greater than the width to form a strip of desired dimensions (Step 200). In one embodiment of the method according to the invention, the first laminate is constructed as described herein with reference to the third embodiment, and has a sufficient width to form a desired multiple of folds or pleats that extend longitudinally along the length, of the first laminate. Although the method as described herein, and as shown in FIG. 12, includes a first laminate comprising a layer of conductive material bonded to a layer of dielectric material, it is understood by those skilled in the art that the laminate can be comprised of two or more layers of a conductive material and two or more layers of a dielectric material to form the first laminate having a multi-layer configuration of, for instance, foil/film/foil/film layers.

The method comprises according folding the first laminate lengthwise wherein an initial step includes folding a portion of the width of the first laminate lengthwise in a first fold to form a first pleat such that the dielectric layer forms an interface inside the first pleat (Step 205). The method comprises bonding or fusing the bondable layer or the fusible film disposed on the dielectric layer of the first pleat to bond or fuse the interface and to seal the first pleat. (Step 210) In one embodiment of the method according to the invention, bonding or fusing the dielectric layer interface includes applying a sufficient heat and/or a sufficient pressure to the first pleat to bond or fuse the bondable layer or fusible film of the dielectric layer. In one embodiment of the method according to the invention, the dielectric layer interface of the first pleat is subjected to a bonding temperature generally in a range of from about 70° C. to about 150° C. for a bonding time of from about 0.1 to about 2.0 seconds. One skilled in the art can adjust a bonding temperature, a bonding time and/or a bonding pressure to obtain ideal results with respect to bonding or fusing the dielectric layer interface of each pleat.

The method further comprises accordion folding the first pleat over a portion of the width of the first laminate lengthwise in a second fold to form a second pleat such that the dielectric layer forms an interface inside the second pleat. (Step 215) In one embodiment of the method according to the invention, the second pleat has a width similar to a width of the first pleat. The method comprises bonding or fusing the bondable layer or fusible film disposed on the dielectric layer of the second pleat to bond or fuse the interface and seal the second pleat (Step 220). The method further comprises accordion folding the second pleat over a portion of the width of the first laminate lengthwise in a third fold to form a third pleat such that the dielectric layer forms an interface inside the third pleat, and the third pleat has a width similar to the first and second pleats. (Step 225) The method comprises bonding or fusing the bondable layer or fusible film of the dielectric layer of the third pleat to bond or fuse the interface and to seal the third pleat (Step 230). The method further comprises repeating Steps 205 to 225 until a desired number of accordion-folded pleats are formed and sealed (Step 235). The method finally comprises opening and separating each pleat having an interface of the conductive layer, folding the first laminate back upon itself and joining longitudinal edges of the first laminate, for instance, by bonding or fusing such that the conductive layer of each pleat faces outward (Step 240). The opened pleats form a multiple of longitudinal channels or grooves defined by the conductive layer of each pleat.

Figure 13:
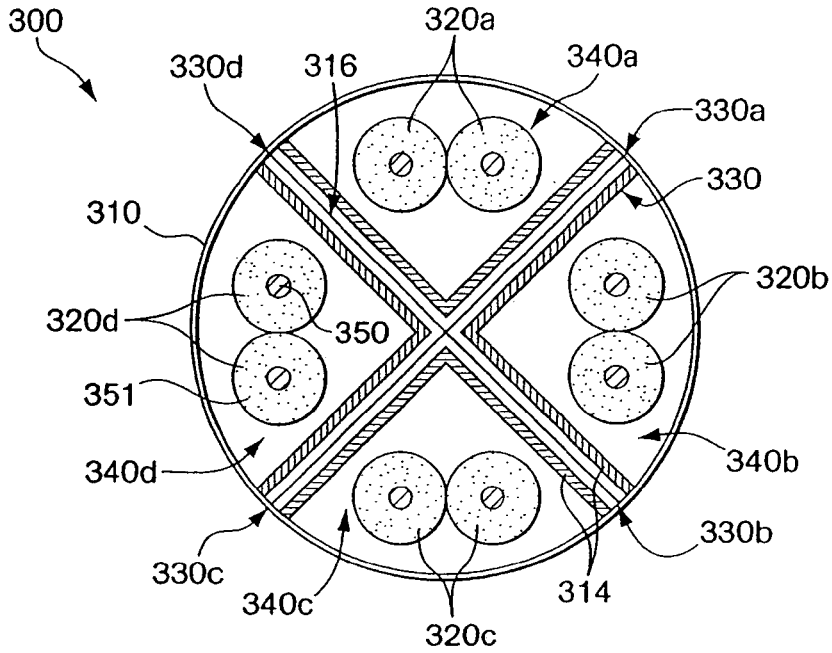
FIG. 13 is a cross-sectional view of a fifth embodiment of the invention providing a cable comprising a single tape configuration having an X-shaped cross-section or profile for separating and wrapping twisted pairs of conductors.

Referring to FIG. 13, a fifth embodiment of the invention provides a communications cable 300 comprising a multifolded composite shielding tape 330 to separate and shield a multiple of conductors 320. The communications cable 300 comprises a jacket 310, a multifolded composite shielding tape 330 situated within and longitudinally coextensive with the jacket 310, and a multiple of conductors 320 disposed between fin-like shielding members 330*a*, 330*b*,

330*c* and 330*d* of the composite tape 330. As shown in FIG. 13, in one embodiment of the invention, the cable 330 includes four twisted pairs of insulated conductors 320*a*, 320*b*, 320*c* and 320*d* and the composite tape 300 defines an initial X-shaped cross-section or profile. The four fin-like shielding members 330*a*, 330*b*, 330*c* and 330*d* extend radially from a center axis or a vertical center line of the composite tape 330 and terminate proximate to the jacket 310. The four shielding members 330*a*, 330*b*, 330*c* and 330*d* define four channels or grooves 340*a*, 340*b*, 340*c* and 340*d* that extend longitudinally along a length of the composite tape 330. Each of the channels or grooves 340*a*, 340*b*, 340*c* and 340*d* is of sufficient size to receive at least one corresponding twisted pair 320*a*, 320*b*, 320*c* and 320*d* during the cabling process.

The inventive principles as described herein with respect to'the fifth embodiment of the invention can be applied to different cable designs including a different number of twisted pairs of conductors. In particular, the initial X-shaped cross-section or profile of the multifolded composite tape 330 illustrated in FIG. 13 should not be considered limiting. In other embodiments of the cable according to the invention, the multifolded composite shielding tape 330 comprises any number of fin-like shielding members to define a corresponding number of channels or grooves to accommodate a multiple of conductors of a specific cable design and to define different initial cross-sections or profiles. In addition, although the embodiment of the cable according to the invention described herein with respect to twisted pairs of insulated conductors; other high-speed data communications media can be used to construct the communications cable according to the invention.

As shown in FIG. 13, each of the four shielding members 330*a*, 330*b*, 330*c* and 330*d* of the composite tape 330 includes an inner core of dielectric material 316 surrounded or encased by layers of conductive material 314. Each layer of conductive material 314 is a continuous layer having a more or less V-shaped cross-section to define each face of the channels or groove 340*a*, 340*b*, 340*c* and 340*d* in which each twisted pair 320*a*, 320*b*, 320*c* and 320*d* is contained. The four shielding members 330*a*, 330*b*, 330*c* and 330*d* of the multifolded composite tape 330 essentially form or define four channels or grooves of conductive material that extend longitudinally along the length of the cable.

Each insulated conductor of each twisted pair 320*a*, 320*b*, 320*c* and 320*d* includes a conductor 350 encased by a layer of insulating material 351. The conductor 350 may include a metallic wire or any other metallic conductor well known in the art such as, although not limited to, copper, aluminum, copper-clad aluminum, etc. The insulating material 351 may be constructed of any suitable material well known in the art such as, although not limited to polyvinylchloride, polyethylene, polypropylene, and flame retardant materials such as fluorinated polymers. The insulated conductors of each twisted pair are helically twisted around one another with a desired longitudinal distance between each complete helical twist, referred to in the art as lay length. It is preferable that each twisted pair of conductors has a different lay length than other twisted pairs that coexist in the cable. It is also preferable that adjacent twisted pairs of conductors are helically twisted in different directions, thereby having different twist directions. Varying the lay lengths and the twist directions of the twisted pairs of conductors within the cable helps to increase the spacing between twisted pairs and prevent adjacent twisted pairs from lying too closely to one another.

As shown in FIG. 13, the four shielding members 330*a*, 330*b*, 330*c* and 330*d* of the multifolded composite tape 330 define four longitudinally extending channels or grooves 340*a*, 340*b*, 340*c* and 340*d*. Each channel or groove is of a sufficient size to receive at least one twisted air such that the four twisted pairs 320*a*, 320*b*, 320*c* and 320*d* can be located within the channels or, grooves extending longitudinally along the length of the cable. During the cabling process, the multifolded composite tape 330 is supplied from a master roll of tape (not shown) and reeled therefrom into a bunching process whereby the twisted pairs are laid into the respective channels or grooves of the composite tape. Typically, one or more forming dies are used to push the twisted pairs into the channels or grooves of the multifolded composite tape positioned by the same or other forming dies such that the channels or grooves are open to receive the twisted pairs. Once the composite tape 330 and the twisted pairs 320*a*, 320*b*, 320*c* and 320*d* are bunched, one or more forming dies are used to helically twist the composite tape and twisted pairs at a predetermined desired lay length or a predetermined desired length to completely twist the composite tape 330 around the twisted pairs. The lay length is preferably in a range of from about 2 inches to about 8 inches.

Figure 14:
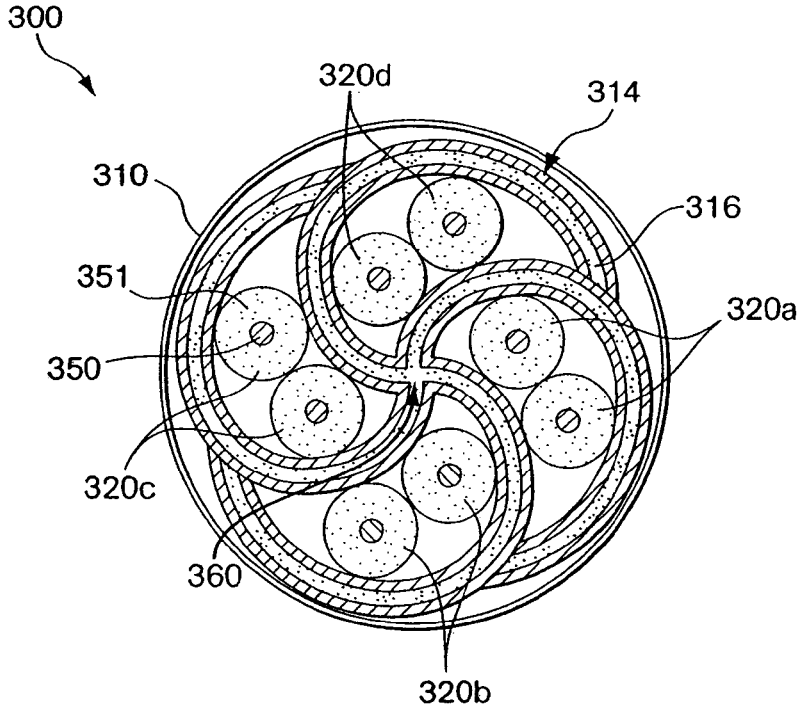
FIG. 14 is a cross-sectional view of the cable of the fifth embodiment, illustrating the single X tape configuration wrapped around four twisted pairs.

Referring to FIG. 14, the twisted configuration 360 of the composite tape 330 and the twisted pairs 320 essentially includes each twisted pair completely wrapped and encased in the conductive layer, of the wall portions facing each channel or groove. The conductive layer facing each groove or channel forms a continuous longitudinal wrap in which each twisted pair is individually wrapped and encased in a closed foil-to-foil conductive shield. Such a communications cable resolves many of the inherent problems associated with communications cables constructed of individually wrapped twisted pairs, which are each separately helically wrapped in shielding tape prior to cabling.

The jacket 310 of the communications cable according to the fifth embodiment of the invention is tubular in shape and constructed of any suitable material such as flexible polymer materials conventionally used in cable construction. Suitable polymer materials include, although are not limited to, polyvinylchloride, polyethylene, polypropylene and flame retardant materials such as fluorinated polymers.

Figure 15:
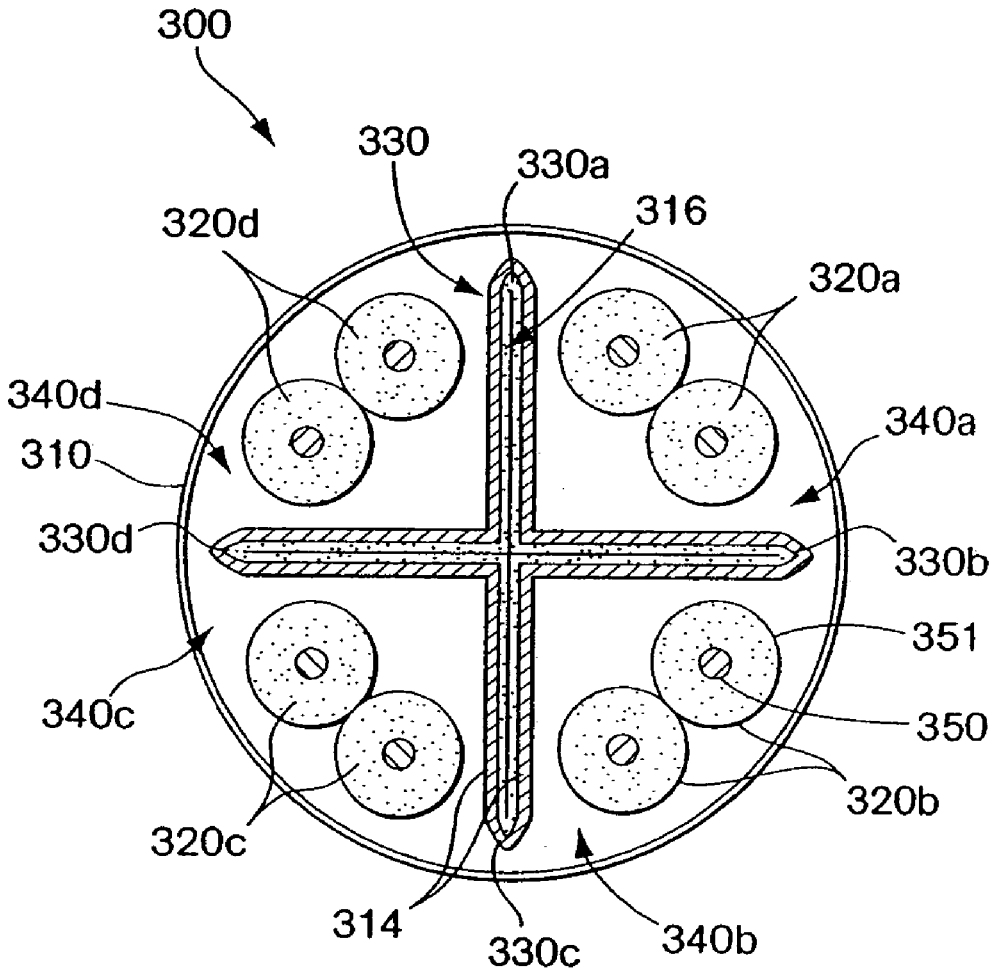
FIG. 15 is a cross-sectional view of a cable of the sixth embodiment comprising a single tape configuration having a +-shaped cross-section or profile formed according to the method of the fourth embodiment.

Referring to FIG. 15, in a sixth embodiment of a communications cable according to the invention, a communications cable 300 is provided with four twisted pairs 320 wrapped in a multifolded composite tape 330 having an initial +-shaped cross-section or profile. The composite tape 330 comprising an initial +-shaped cross-section or profile may be constructed by a different method than the composite tape comprising an initial X-shaped cross-section or profile. The +-shaped cross-section similarly comprises four shielding members 330*a*, 330*b*, 330*c* and 330*d* that radially extend from a center axis and a vertical center line on a center axis of the composite tape 330 and terminate proximate to the jacket 310. The four shielding members 330*a*, 330*b*, 330*c* and 330*d* define four longitudinal channels or grooves 340*a*, 340*b*, 340*c* and 340*d* with each channel or groove being of sufficient size to receive a twisted pair. As shown in FIG. 15, each of the four shielding members 330*a*, 330*b*, 330*c* and 330*d* includes an inner core of dielectric material 316 that is sandwiched by external layers of conductive material 314. Each layer of conductive material 314 is formed as a continuous layer of material having a more or less L-shaped cross-section such that each L-shaped conductive layer defines the faces each channel of groove 340*a*, 340*b*, 340*c* and 340*d* and each twisted pair 320*a*, 320*b*, 320*c* and 320*d* contained therein.

The multifolded composite tape 330 having an +-shaped cross-section or profile is formed by a single laminate strip constructed of at least one layer of conductive material and at least one layer of dielectric material accordion-folded into a multiple of folds or pleats, as described herein with respect to the method of the fourth embodiment. Although FIG. 15 illustrates the cable including four parallel longitudinal channels or grooves for containing and wrapping four twisted pairs, it is well understood that the single laminate strip can be accordion-folded into any number of folds or pleats to accommodate any number of twisted pairs of conductors or other data communications media incorporated with the communications cable.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto.

What is claimed is:

1. A tape for use within an interior defined by a cable jacket, the tape comprising:

two or more elongated fin-like members joined along their edges, each elongated fin-like member having a width extending radially from their edges and a length extending longitudinally parallel to and along their edges such that each pair of adjacent elongated fin-like members defines therebetween a channel, and each elongated fin-like member includes an inner layer of dielectric material disposed between a first layer of conductive material and a second layer of conductive material such that the layers of conductive material face each other within each channel.

2. The tape of claim 1, wherein each elongated fin-like member is conformable such that the tape can be arranged within the cable jacket.

3. The tape of claim 1, wherein each pair of adjacent elongated fin-like members defines a void sufficient to accept at least one conductor.

4. The tape of claim 3, wherein each elongated fin-like member is conformable such that at least a portion of each pair of adjacent elongated fin-like members can wrap around the at least one conductor.

5. The tape of claim 1, wherein the width of each elongated fin-like member is greater than an internal radius of the cable jacket and wherein the internal radius is defined as a distance from a center point of an internal diameter of the cable jacket to an internal perimeter surface of the cable jacket.

6. The tape of claim 5, wherein each elongated fin-like member is conformable such that the tape can be arranged within the jacket.

7. The tape of claim 6, wherein each pair of adjacent elongated fin-like members defines a void sufficient to accept at least one conductor.

8. The tape of claim 7, wherein each elongated fin-like member is conformable such that at least a portion of each pair of adjacent elongated fin-like members can wrap around the at least one conductor.

9. The tape of claim 1, further comprising a layer of bondable material disposed directly between each of the first layer and the second layer of conductive material and the inner layer of dielectric material.

10. The tape of claim 9, wherein the layer of bondable material includes an adhesive coat.

11. The tape of claim 9, wherein the layer of bondable material includes a layer of heat fusible film.

12. The tape of claim 11, wherein the heat fusible film includes one or more compounds wherein each compound is selected from the group consisting of ethyl acrylic acid (EAA), ethyl vinyl acetate (EVA), thermoplastic polymer, and combinations thereof.

13. The tape of claim 1, wherein each layer of conductive material has a thickness of from about 0.00015 inch to about 0.006 inch.

14. The tape of claim 1, wherein each of the first layer and the second layer of conductive material includes a material selected from the group consisting of aluminum, copper, tinned copper, silver, steel and combinations thereof.

15. The tape of claim 1, wherein the inner layer of dielectric material includes a thickness of from about 0.0001 inch to about 0.006 inch.

16. The tape of claim 1, wherein the dieleciric material includes a material selected from the group consisting of polyester, polypropylene, polyethylene, polyvinyl chloride, polyvinylidene fluoride, polyamide, polyimide and combinations thereof.

17. The tape of claim 1, wherein the two or more elongated fin-like members include four elongated members to define the tape with an X-shape cross-section and four channels.

18. The tape of claim 17, wherein each pair of adjacent elongated fin-like members defines a void sufficient to accept at least one conductor.

19. The tape of claim 18, wherein each elongated fin-like member is conformable such that at least a portion of each pair of adjacent elongated fin-like members can wrap around the at least one conductor.

20. The tape of claim 1, wherein the two or more elongated fin-like members includes multiple elongated fin-like members such that the tape has multiple channels and wherein each pair of adjacent elongated fin-like members defines a void sufficient to accept at least one conductor.

21. The tape of claim 20, wherein each elongated fin-like member is conformable such that at least a portion of each pair of adjacent elongated fin-like members can wrap around the at least one conductor.

22. A cable comprising:

a tubular jacket;

a tape disposed within the tubular jacket, the tape having two or more elongated fin-like members joined along their edges, each elongated fin-like member having a width extending radially from their edges and a length extending longitudinally parallel to and along their edges such that each pair of adjacent elongated fin-like members defines therebetween a channel, and each elongated fin-like member includes an inner layer of dielectric material disposed between a first layer of conductive material and a second layer of conductive material such that the layers of conductive material face each other within the channel; and at least one conductor disposed in at least one channel, wherein at least a portion of the pair of adjacent elongated fin-like members defining the channel wraps around the conductor.

23. The cable of claim 22, wherein each elongated fin-like member is conformable such that the tape can be arranged within the tubular jacket.

24. The cable of claim 22, wherein the width of each fin-like elongated member is greater than an internal radius of the tubular jacket and wherein the internal radius is defined as a distance from a center point of an internal diameter of the tubular jacket to an internal perimeter surface of the tubular jacket.

25. The cable of claim 24, wherein each elongated fin-like member is conformable such that the tape can be arranged within the tubular jacket.

* * * * *